US010161572B2

(12) United States Patent
Rooijmans

(10) Patent No.: US 10,161,572 B2
(45) Date of Patent: Dec. 25, 2018

(54) SPECTRALLY ENHANCED WHITE LIGHT FOR BETTER VISUAL ACUITY

(71) Applicant: GEMEX CONSULTANCY B.V., Oss (NL)

(72) Inventor: Johannes Otto Rooijmans, Oss (NL)

(73) Assignee: GEMEX CONSULTANCY B.V., Oss (NL)

( * ) Notice: Subject to any disclaimer, the term of this patent is extended or adjusted under 35 U.S.C. 154(b) by 330 days.

(21) Appl. No.: 14/915,762

(22) PCT Filed: Sep. 3, 2014

(86) PCT No.: PCT/NL2014/050598

§ 371 (c)(1),
(2) Date: Mar. 1, 2016

(87) PCT Pub. No.: WO2015/034350

PCT Pub. Date: Mar. 12, 2015

(65) Prior Publication Data

US 2016/0195227 A1 Jul. 7, 2016

(30) Foreign Application Priority Data

Sep. 3, 2013 (NL) ..... 2011375

(51) Int. Cl.
*F21K 99/00* (2016.01)
*F21K 9/60* (2016.01)
(Continued)

(52) U.S. Cl.
CPC ..... *F21K 9/50* (2013.01); *F21K 9/60* (2016.08); *F21Y 2113/17* (2016.08); *F21Y 2115/10* (2016.08)

(58) Field of Classification Search
CPC ..... F21K 9/50; F21K 9/60; F21Y 2113/17; F21Y 2113/10
See application file for complete search history.

(56) References Cited

U.S. PATENT DOCUMENTS 6,414,426 B1 7/2002 Akashi et al.
2003/0063462 A1* 4/2003 Shimizu ..... H01L 25/0753 362/230

(Continued)

FOREIGN PATENT DOCUMENTS

EP 2 469 983 A2 6/2012
WO 2006/132533 A2 12/2006
WO 2009/013317 A1 1/2009

OTHER PUBLICATIONS

International Search Report, dated Nov. 24, 2014, from corresponding PCT application.

*Primary Examiner* — Laura Tso
(74) *Attorney, Agent, or Firm* — Young & Thompson

(57) ABSTRACT

A lighting configuration for providing improved vision acuity includes a first light source emitting light having a first wavelength peak in the range from 500 to 530 nm; a second light source emitting light having a second wavelength peak in the range from 600 to 640 nm; and a third light source emitting light having a third wavelength peak in the range from 440 to 460 nm. The radiated power at 555 nm is less than 15% of the radiated power at the wavelength of the second wavelength peak. The light configurations are characterized by an S/P ratio between 2 and 5. Optionally the radiated power at 480 nm is at least 20% of the second wavelength peak. The light sources used in the lighting configuration can be LEDs, preferably LEDs that are substantially free of a color conversion layer.

14 Claims, 3 Drawing Sheets

Figure 1:
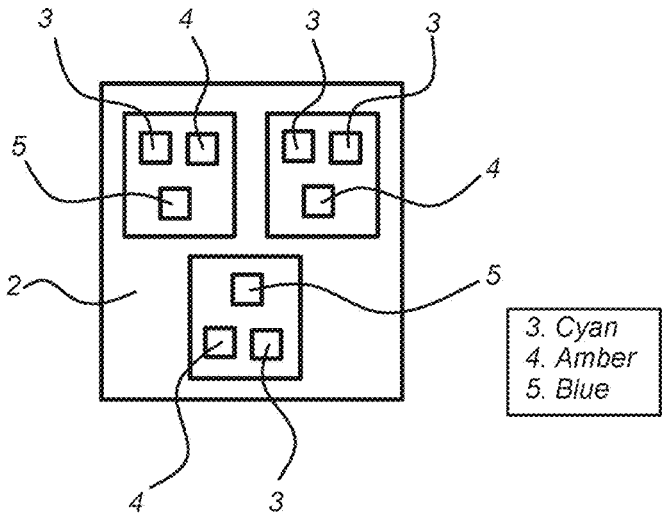

(51) Int. Cl.
*F21Y 115/10* (2016.01)
*F21Y 113/17* (2016.01)

(56) References Cited

U.S. PATENT DOCUMENTS

| | | | | |
|---|---|---|---|---|
| 2006/0149607 | A1 | 7/2006 | Sayers et al. | |
| 2009/0122530 | A1* | 5/2009 | Beers | F21K 9/00 362/230 |
| 2015/0241026 | A1* | 8/2015 | Cui | G02F 1/133603 348/743 |
| 2016/0003449 | A1* | 1/2016 | McDavitt | G02F 1/133603 362/84 |

* cited by examiner

SPECTRALLY ENHANCED WHITE LIGHT FOR BETTER VISUAL ACUITY

BACKGROUND OF THE INVENTION

1. Field of the Invention

The present invention relates to a lighting configuration emitting light of a predefined spectrum with a high S/P ratio at common practical CCT values, in particular to a lighting configuration emitting light of a spectrally enhanced spectrum for improved visual acuity under mesopic and photopic conditions.

2. Description of the Related Art

Certain prior art lighting configurations aim at improving visibility under mesopic conditions.

PCT Application WO2006/132533 A2 relates to a lighting configuration that provides an improved visibility compared with conventional utility lighting. The lighting configuration is designed to emit light in a first wavelength region and light in a second wavelength region. The first wavelength region comprises wavelengths of 500-550 nm. The second wavelength region comprises wavelengths of 560-610 nm. The lighting unit is designed to generate light having a dominant wavelength from the first wavelength region in such a way that the eye sensitivity of the human eye is dominated by rods.

WO 2009/013317 A1 relates to a lighting configuration for illuminating an area under mesopic conditions. The lighting configuration has one or more LEDs emitting substantially monochromatic light in a first wavelength region. The lighting configuration further has one or more LEDs emitting substantially monochromatic light in a second wavelength region. Thereby, the combination of LEDs is such that, in use, the light provided by the lighting configuration has a ratio of scotopic to photopic light (S/P-ratio) greater than 2.

EP 2469983 A2 claimed improvements by illuminating an area under mesopic conditions by applying blue LEDs covered with a colour conversion layer emitting light in the range of a first intensity peak at a wavelength of 440 to 480 nm and a second intensity peak (12) at a wavelength of 600 to 650 nm. Preferred embodiments comprise LEDs with a third color conversion layer emitting light having a wavelength in the 550-590 nm range.

US 2006/0149607 discloses a lighting configuration comprising at least two light sources emitting light of different wavelengths. One light source has a wavelength substantially corresponding to the scotopic maximum (505 nm); a second light source has a wavelength substantially corresponding to the photopic maximum (555 nm).

The prior art reflects an incomplete understanding of the contributions of specific parts of the visible spectrum to the overall performance of a lighting configuration in providing optimum visual acuity.

Thus, there is a need for a lighting configuration providing spectrally enhanced light for improved visual acuity.

BRIEF SUMMARY OF THE INVENTION

The present invention addresses these problems by providing a lighting configuration comprising a first light source designed to emit light having a first wavelength peak in the range from 500 to 530 nm; a second light source designed to emit light having a second wavelength peak in the range from 600 to 640 nm and a third light source designed to emit light having a third wavelength peak in the range from 440 to 460 nm. This means that there is no light source having a wavelength substantially corresponding to the photopic maximum of 550 nm. The lighting configuration provides a spectral power distribution with a Scotopic/Photopic (S/P) ratio between 2 and 5 and a radiated power at 555 nm that is less than 10 to 50% of the radiated power at the wavelength of the second wavelength peak.

Blending the light of three light sources operating in the identified wavelength regions results in highly effective lighting.

DETAILED DESCRIPTION OF THE INVENTION

The following is a detailed description of the invention.

Definitions

The term "photopic" as used herein refers to vision in light wavelengths within the CIE photopic luminosity function, which has a near-Gaussian distribution and a peak at 555 nm.

The term "scotopic" as used herein refers to vision in light wavelengths within the CIE scotopic luminosity function, which has a near-Gaussian distribution and a peak at 507 nm.

The term "scotopic/photopic ratio" as used herein refers to the amount of light produced by a light source in the scotopic region divided by the amount of light produced by that same light source in the photopic region.

"The Correlated Color Temperature" (CCT) of a light source is the black body temperature that produces light of the same hue as that of the light source. The CCT is expressed in Kelvin (K).

The "Color Rendering Index" (CRI) of a light source refers to the ability of the light source to faithfully render colors of objects illuminated by the light source. The index expresses this ability with reference to daylight as a standard light source with a CCT of 6500K referred to as D65 or an incandescent bulb or a halogen bulb having a CCT of 3200K, which have a CRI of 100.

"Chromaticity" of a light source refers to the position of the color of the light emitted by the light source in the CIE 1931 xy chromaticity space. Graphic representations of the xy chromaticity space generally contain a curved line showing the chromaticities of black-body light sources of various temperatures.

In its broadest aspect the present invention relates to a lighting configuration comprising a first light source designed to emit light having a first wavelength peak in the range from 500 to 530 nm; a second light source designed to emit light designed to emit light having a second wavelength peak in the range from 600 to 640 nm and a third light source designed to emit light having a third wavelength peak in the range from 440 to 460 nm, and no light source having a wavelength substantially corresponding to the photopic maximum, said lighting configuration providing a spectral power distribution with a Scotopic/Photopic (S/P) ratio between 2 and 5 and a radiated power at 555 nm that is less than 10 to 50% of the radiated power at the wavelength of the second wavelength peak.

The lighting configuration of the invention embodies several new insights into the functioning of the human eye in artificial light. It should be appreciated that the established opinion as regards rating the performance of an artificial light source is based on science that was developed in the first decennia of the twentieth century with reference to the incandescent light bulb.

The incandescent light bulb produces light by sending a current through a filament of, for example, tungsten. The filament is dimensioned so it becomes hot when an electric current of the designed strength is led through it. It follows that the filament behaves as a black-body, and that the emitted spectrum and the CCT of the incandescent bulb correspond to the temperature of the filament.

One implication is that incandescent light bulbs have low scotopic/photopic ratio (typically between 1.4 and 1.5). Since the rods in the retina were believed to have little or no activity under photopic conditions, the contribution of the scotopic light output of a light source has been largely ignored. Likewise, the amount of light produced by a light source, expressed in lumens, can be a misleading parameter as the definition of lumen overstates the contribution of photopic light and understates the contribution of scotopic light.

There is a need for reducing the electric energy required for producing artificial light. The energy efficiency of a light source tends to be expressed in lumens/Watt. Because the unit lumen overstates the contribution of the photopic light, and understates the contribution of scotopic light, the unit lumens/Watt understates the energy efficiency of light sources having a high S/P ratio. This artifact has a number of undesirable consequences:

(a) when switching from a traditional light source having low S/P ratio to a new light source having higher S/P ratio the number of installed light sources (based on a lumens comparison) is too high, which results in energy savings that are less than what was achievable, and an undeserved reputation of harshness and glare for the new light source;
(b) opportunities for energy savings are missed, because the calculated payout (based on a lumens comparison) is considered too long;
(c) suboptimum design of new light sources in an ill-conceived attempt to increase the photopic lumens output of the light source.

The lighting configuration of the present invention addresses these problems by maximizing the S/P ratio, so that maximum use is made of the pupil dynamics by the rods in a human retina.

Another established misconception is the role of pupil size under mesopic lighting conditions. In general, as the light becomes dimmer, the pupil size increases so as to allow more of the available light to reach the retina. It is believed that pupil size is controlled by melanopsin in the retina, which is sensitive to light having a wavelength of 480 nm. It has been suggested to reduce the amount of 480 nm light in the spectrum of a light source so as to maximize the pupil size (see EP 2469983 A2).

It has now been found that it is instead desirable to prevent the pupil size from becoming too large under mesopic lighting conditions. When the pupil is less than fully dilated the lens of the eye produces a sharper image on the retina, resulting in improved vision though less light reaches the retina because of a somewhat smaller pupil size. In addition, a smaller pupil size results in a greater depth-of-field, so that the eye has a less frequent need to adjust its focus. This results in a significantly reduced fatigue.

The lighting construction of the present invention further embodies the inventor's discovery that the high S/P ratios of the invention can be obtained while producing light having a high color sensation, and having a position on the xy chromaticity space that is on or near the black-body curve.

Light Emitting Diodes (LEDs) are particularly suitable for use as light sources in the lighting configuration of the invention. Accordingly, at least one of the first light source, the second light source and the third light source may comprise a Light Emitting Diode. Preferably all three of the first light source, the second light source and the third light source comprise a Light Emitting diode.

A LED having a wavelength peak in the range from 500 to 530 nm can be referred to as a cyan LED. A LED having a wavelength peak in the range from 600 to 640 nm can be referred to as a red LED. A LED having a wavelength peak in the range from 440 to 460 nm can be referred to as a blue LED.

All three types of LED can be a LED having a wavelength peak in the blue part of the spectrum, with the cyan LED and the red LED being provided with a color conversion layer to convert the color of the LED to the desired wavelength. However, color conversion layers have significant disadvantages in terms conversion losses referred to as Stokes shift and energy dissipation shortening useful life of the LED. It is possible to obtain the desired wavelengths with LEDs that are substantially free of a color conversion layer. Lighting configurations having at least one LED that is substantially free of a color conversion layer are therefore preferred. More preferred are lighting configurations in which all LEDEs are substantially free of a color conversion layer.

An example of a LED emitting red light without a color conversion layer is a LED based on AlInGaP or InGaN. Examples of LEDs emitting cyan light or blue light without a color conversion layer include GaN, InGaN and GaAs. Other compositions are possible, such as GaP:ZnO, GaP, GaAsPN, AlGaAs/GaAs, AlInGaP/GaAs, AlInGaP/GaP, and ZnCdSe. The skilled person is familiar with techniques for adjusting the spectral distribution to the desired range.

It has been found that vision acuity under mesopic lighting conditions is improved when the pupil of the eye is made to contract somewhat. Contraction of the pupil is triggered by light having a wavelength of about 480 nm, as this is the wavelength to which melanopsin is sensitive. A preferred embodiment of the lighting configuration of the present invention has a spectral power distribution such that the radiated power at 480 nm is at least 20% of the second wavelength peak.

In an embodiment the spectral power distribution of the lighting configuration comprises a first minimum at a wavelength between 470 and 490 nm, and a second minimum at a wavelength between 550 and 590 nm. In particular the second minimum contributes to the high S/P ratios obtained with these lighting configurations. The absence of a light source having a wavelength corresponding to the photopic maximum further increases the S/P ratio.

The relative contributions of the three light sources can be balanced to produce a desired color temperature and a corresponding S/P ratio. For example, the ratios of the light outputs of the first light source, the second light source and the third light source can be selected so that the lighting configuration has an S/P ratio between 2.5 and 3 at a Correlated Color Temperature of 4000K to 6000K. In an alternate embodiment the ratios are selected to produce a lighting configuration that has an S/P ratio between 3 and 3.5 at a Correlated Color Temperature of 6000K to 8000K. In general it is possible to create CCT values in the range of from 4000K to 10,000K.

Like so many parameters used in rating the performance of an artificial light source, the Color Rendering Index is based on the characteristics of an incandescent light bulb, which makes it difficult or even meaningless to determine a CRI for the lighting configuration of the present invention. However, it is possible to compare the color rendering of the lighting configuration to those of incandescent light bulbs with known CRI, until a match has been found. The result of this comparison is referred to herein as the perceived Color Rendering Index. It has been found that the lighting configuration can have a perceived CRI of at least 100. More importantly, the lighting configuration can have a perceived CRI under mesopic lighting conditions of at least 100.

The color of artificial light can be depicted as a location, expressed as x- and y-coordinates in the CIE chromaticity space. It is desirable to position the light color as close as possible to the black-body curve in the chromaticity diagram. The chromaticity coordinates of a point on the black-body curve for a specific black-body temperature T can be written as x(bbT) and y(bbT), respectively. The chromaticity coordinates of a lighting configuration with the same color temperature T can be written as x(lcT) and y(lcT), respectively. The chromaticity of the lighting configuration is close to the black-body curve, so that $|x(lcT)-x(bbT)|<0.02$, and $|(y(lcT)-y(bbT)|<0.02$. wherein $|x(lcT)-x(bbT)|$ is the absolute value of x(lct)−x(bbT) and $|(y(lcT)-y(bbT)|$ is the absolute value of y(lcT)−y(bbT).

The S/P ratio of a light source is very important for the perceived light intensity. The light intensity is measured in the SI unit "lux". The perceived light intensity is given by the formula:

$$\text{Perceived light intensity}=(\text{measured light intensity})\times(S/P)^{0.8}$$

For example, the maximum S/P ratio of an optimal full spectrum light source having a CCT of 4000K is 1.87. If the light source has a measured light intensity of 200 lux, the perceived light intensity is $200\times1.87^{0.8}=330$ lux. A lighting configuration of the same CCT (4000K) has an S/P ratio of 2.5. If the measured light intensity is again 200 lux, the perceived light intensity is $200\times2.5^{0.8}=416$ lux. Compared to the highest S/P theoretical blackbody 4000K light, source the gain in perceived light intensity is 116/300×100%=38.7%.

Even greater gains can be obtained at higher CCT values. The following table compares theoretical maximum S/P values for black-body light sources and the S/P values obtainable with the lighting configuration of the invention.

| CCT (Kelvin) | S/P ratio (black-body) | S/P ratio (invention) |
|---|---|---|
| 3000 | 1.48 | 2.1 |
| 4000 | 1.87 | 2.5 |
| 5000 | 2.15 | 3.0 |
| 6000 | 2.36 | 3.4 |
| 10000 | 2.83 | 3.6 |

DESCRIPTION OF ILLUSTRATIVE EMBODIMENTS/EXAMPLES

The following is a description of certain embodiments of the invention, given by way of example only.

FIG. 1 is a schematic representation of an embodiment of the invention. Lighting configuration 2 comprises three groupings of cyan LEDs 3, red LEDs 4 and blue LEDs 5. It will be understood that the color balance can be varied by varying the respective powers of the three types of LED, and/or by using unequal numbers of LEDs of each type. For example, the lighting configuration of FIG. 1 may comprise four red LEDs, three cyan LEDs and three blue LEDs; or three red LEDs, two cyan LEDs and two blue LEDs; etc. In a preferred embodiment the lighting configuration contains only cyan, blue and red LEDs.

Figure 2:
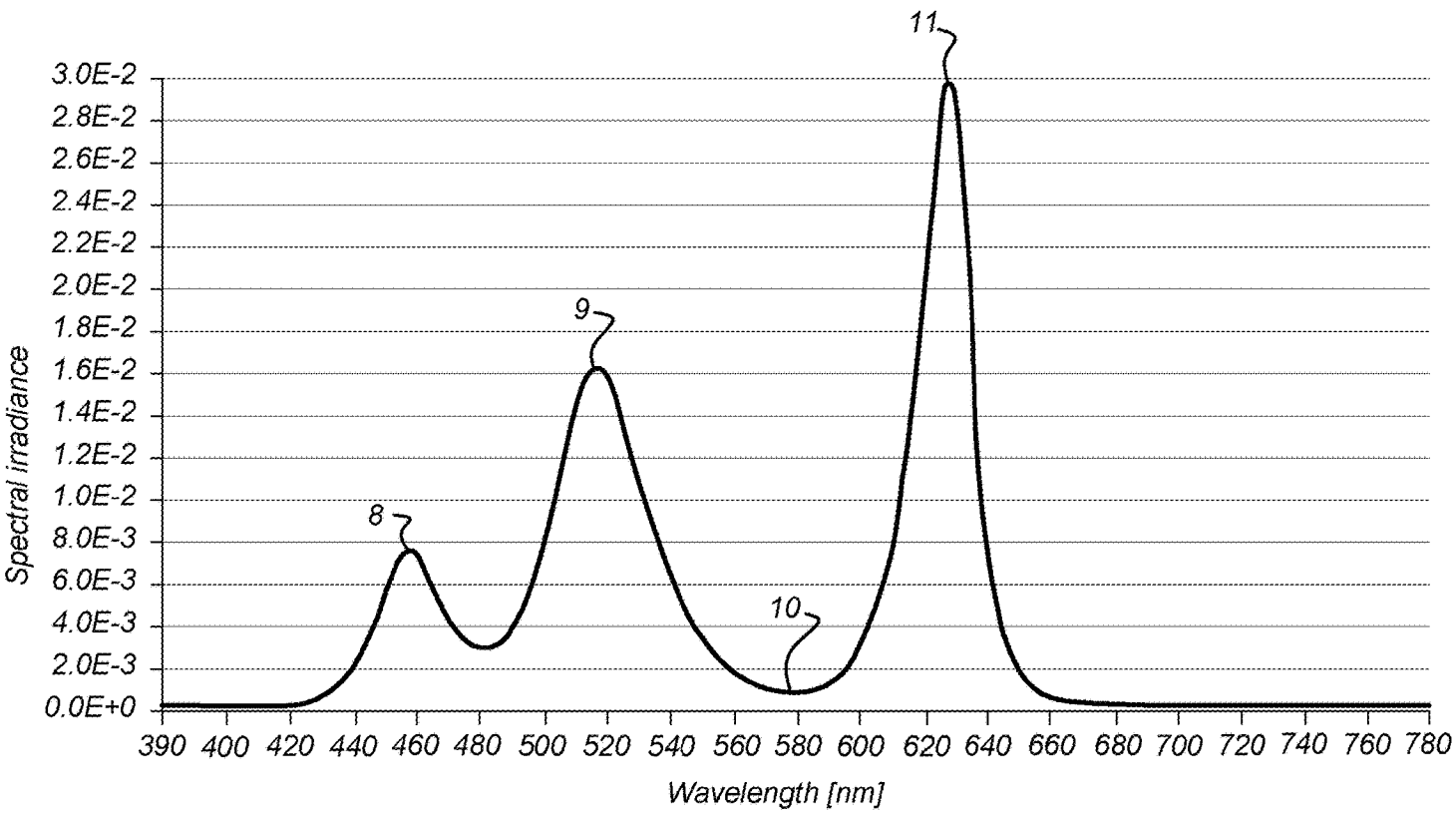

FIG. 2 shows the spectral power distribution of a lighting configuration having a CCT of 4000K. The distribution comprises three peaks; peak 8 is at about 458 nm; peak 9 is at about 515 nm; and peak 11 is at about 628 nm. The lighting configuration produces significant power at 480 nm. The spectral power at 555 nm (shown at 10) is kept low.

Figure 3:
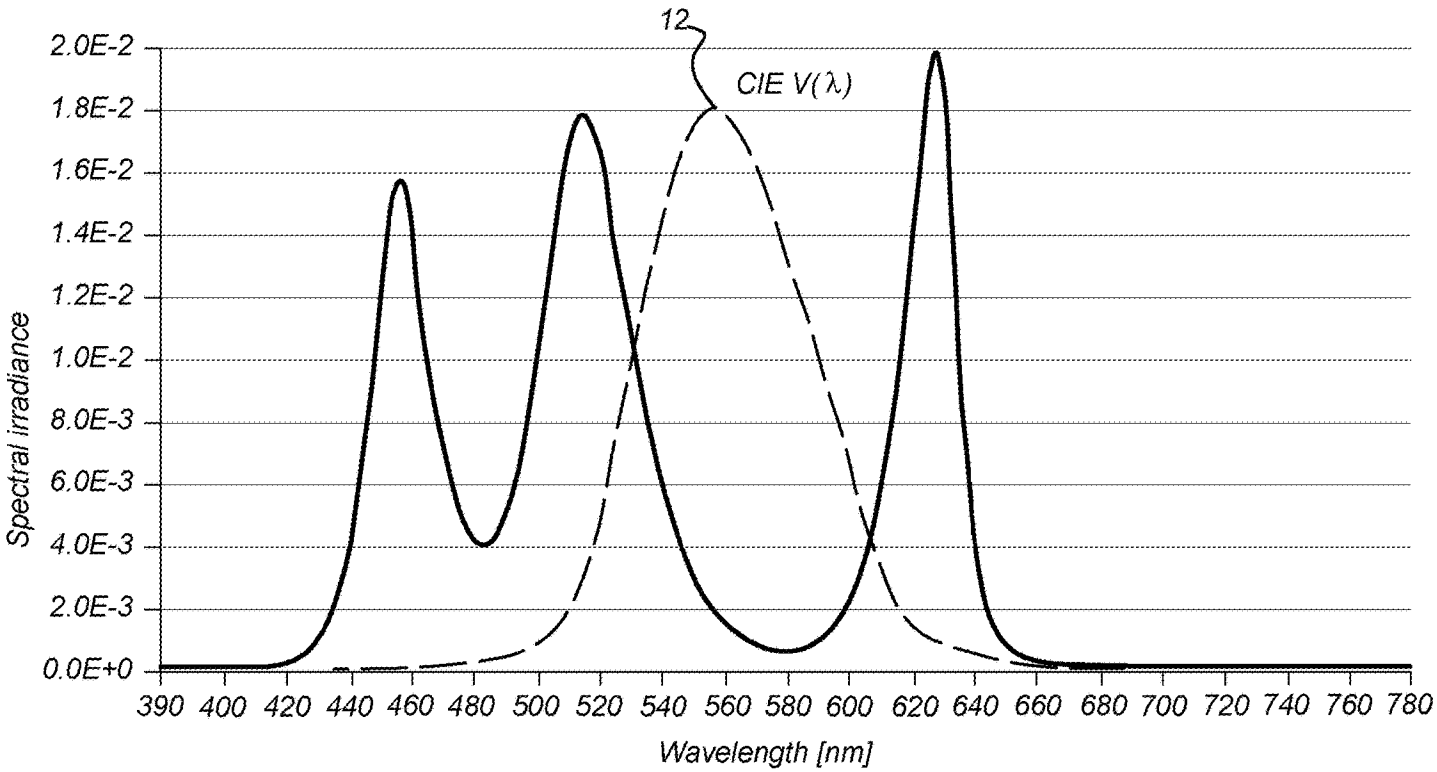

FIG. 3 shows the spectral power distribution of a lighting configuration having a CCT of 8000K. As compared to FIG. 2, the peaks at 458 nm and 515 nm are significantly higher, resulting in a much "cooler" light color. Shown in FIG. 3 is also the standard CIE V(λ) curve, with a peak at 555 nm. It will be clear that the lighting configuration would receive a poor lumens rating. Yet, in use the lighting configuration scores very high in terms of comfort and absence of fatigue.

Thus, the invention has been described by reference to certain embodiments discussed above. It will be recognized that these embodiments are susceptible to various modifications and alternative forms well known to those of skill in the art.

Many modifications in addition to those described above may be made to the structures and techniques described herein without departing from the spirit and scope of the invention. Accordingly, although specific embodiments have been described, these are examples only and are not limiting upon the scope of the invention.

What is claimed is:

1. A. lighting configuration comprising a first light source designed to emit light having a first wavelength peak in the range from 500 to 530 nm; a second light source designed to emit light having a second. wavelength peak in the range from 600 to 640 nm and a third light source designed to emit light having a third wavelength peak in the range from 440 to 460 nm, and no light source having a wavelength substantially corresponding to the photopic maximum, said lighting configuration providing a spectral power distribution with a Scotopic/Photopic (S/P) ratio between 2 and 5 and a radiated power at 555 nm that is less than 10 to 50 % of the radiated power at the wavelength of the second. wavelength peak.

2. The lighting configuration of claim 1 wherein at least one of the first light source, the second light source and the third light source comprises a Light Emitting Diode (LED).

3. The lighting configuration of claim 2 wherein all three of the first light source, the second light source and the third light source comprise a Light Emitting Diode (LED).

4. The lighting configuration of claim 2 wherein at least one of the LEDs is substantially free of a color conversion layer.

5. The lighting configuration of claim 1 wherein the radiated power at 480 nm is at least 20 % of the second wavelength peak.

6. The lighting configuration of claim 1 wherein the spectral power distribution comprises a first minimum at a wavelength between 470 and 490 nm and a second minimum at a wavelength between 550 and 590 nm.

7. The lighting configuration of claim 1 wherein the ratios of light outputs of the first light source, the second light source and the third light source create an S/P ratio between 2.5 and 3 at a Correlated Color Temperature (CCT) of 4000 to 6000K.

8. The lighting configuration of claim 1 wherein the ratios of light outputs of the first light source, the second light source and the third light source create an S/P ratio between 3 and 3.5 at a CCT of 6000 to 8000K.

9. The lighting configuration of claim 1 wherein the first light source, the second light source and the third light source are LED light sources constituted of a cyan die, a red and a blue die, respectively.

10. The lighting configuration of claim 1 having a CCT between 4.000 Kelvin and 10,000 Kelvin.

11. The lighting configuration of claim 1 providing light having a perceived Color Rendering Index (CRI) of at least 100.

12. The lighting configuration of claim 11 providing light having a perceived Color Rendering Index (CRI) of at least 100 under mesopic lighting conditions.

13. The lighting configuration of claim 1 emitting light having a CCT between 4000K and 8500K and chromaticity x,y coordinates x(lcT) and y(lcT) close to the corresponding black body coordinates x(bbT) and y(bbT), such that $|x(lcT)-x(bbT)|<0.02$, and $|(Y(lcT)-Y(bbT)|<0.02$.

14. The lighting configuration of claim 3 wherein at least one of the LEDs is substantially free of a color conversion layer.

* * * * *